United States Patent [19]

Donnelley

[11] 4,209,961

[45] Jul. 1, 1980

[54] GUIDE MECHANISM FOR SELF-GUIDING STRETCH-WRAP MACHINE

[75] Inventor: James R. Donnelley, Los Angeles, Calif.

[73] Assignee: Stevenson Industries, Northridge, Calif.

[21] Appl. No.: 950,601

[22] Filed: Oct. 11, 1978

[51] Int. Cl.[2] ..... B65B 13/10

[52] U.S. Cl. ..... 53/588; 33/27 K; 53/210; 74/569; 409/126

[58] Field of Search ..... 53/210, 139.3, 211, 53/587, 588, 556; 100/13, 27; 33/23 K, 27 K; 74/569; 156/486; 51/101 R, 101 LG; 409/126

[56] References Cited

U.S. PATENT DOCUMENTS

| | | | |
|---|---|---|---|
| 1,273,892 | 7/1918 | Lund | 51/100 R |
| 1,893,217 | 1/1933 | Baritch | 74/569 |
| 2,427,725 | 9/1947 | Hoeber | 74/569 |
| 2,877,662 | 3/1959 | Woydt | 74/569 |
| 3,359,918 | 12/1967 | Gasassa | 74/569 |
| 3,745,720 | 7/1973 | Savage | 51/101 LG |
| 3,979,928 | 11/1976 | Noirot et al. | 74/569 |
| 4,095,395 | 6/1978 | Goldstein | 53/210 |

FOREIGN PATENT DOCUMENTS

| | | | |
|---|---|---|---|
| 784689 | 7/1935 | France | 74/569 |

*Primary Examiner*—John Sipos
*Attorney, Agent, or Firm*—Allan M. Shapiro

[57] ABSTRACT

Motive unit carries stretch-wrap unit around stationary material to be wrapped. Guide ski follows around the material to be wrapped and controls the steering of the motive unit so that the material is wrapped into a unit.

18 Claims, 4 Drawing Figures

GUIDE MECHANISM FOR SELF-GUIDING STRETCH-WRAP MACHINE

BACKGROUND OF THE INVENTION

1. Field of the Invention

This invention is directed to a guide mechanism for guiding a stretch-wrap machine around material to be wrapped.

2. Description of the Prior Art

Modern mechanized handling requires that a number of small packages be packed together so that they can be handled in larger units. Pallets are used as a base, and packages are stacked on the pallet to a convenient size and weight for mechanical handling. One approach to retaining the packages on the pallet has been steel banding. Steel bands were placed around the packages and the pallet and the bands tightened and clamped. The problem with steel banding is that loads can shift, and under the wrong circumstances, all the packages on the outer extremities of the load directly under the steel bands can be crushed. Furthermore, the steel bands are difficult and dangerous to handle. Steel bands are most useful on heavy metal objects, such as pipe and other forms of steel. It must be noted that steel banding does not provide any weather protection for the packages.

A newer method of securing packages on a pallet to provide a palletized load is to shrink wrap the packages and the pallet. In this arrangement, bags are made out of shrink material (usually polyethylene), and the bag is placed over the palletized packages. Thereupon, the bag is subjected to heat whereupon it shrinks to unitize the palletized load. Shrink wrap is useful for loads which are of uniform size, but requires special equipment for causing the shrinkage. Since heat is used to cause the shrinkage, it cannot be used in cold rooms or other areas where high heat loads are objectionable. Furthermore, it cannot be used over polyethylene wrapped packages because of sticking between the shrink wrap material and such packages.

To overcome these disadvantages, stretchwrapping has been developed. In these machines, one of which is seen in Lancaster U.S. Pat. No. 3,867,806, a stack of packages is placed on a turntable. Usually, these packages are mounted on a pallet. The turntable is rotated, and the palletized load of packages is wrapped with a stretch-wrap material. This material may be polyethylene or polyvinylchloride web or film and is manufactured to be able to stretch at least 25 percent. During wrapping of the load, tension on the stretchwrap film provides a tension which stretches the film from about 15 to 25 percent. The film is thin, usually about 1/1000th of an inch, and the load is wrapped with as many thicknesses as is necessary to obtain the desired unitized load strength.

The stretch-wrap film may be as tall as the load or may be narrower than the height of the load. In the latter case, the narrower film is spiral-wrapped around the load. Since more wraps are necessary at the top and bottom of the load than at the middle for best strength, this is more economical of material. However, these stretch-wrap concepts have been limited to those loads which can be placed on the turntable and rotated.

U.S. Pat. No. 4,095,395 to Joseph Goldstein is directed to a stretch-wrap machine wherein a motive unit carries the stretch-wrap unit and wherein the motive unit is guided around the material to be wrapped. In this arrangement, the material to be wrapped is in a stationary position. This invention is directed to a guide ski assembly useful in such a self-guiding stretch-wrap machine and which is particularly arranged for guiding the stretch-wrap machine around uneven material loads.

SUMMARY OF THE INVENTION

In order to aid in the understanding of this invention, it can be stated in essentially summary form that it is directed to a self-guiding stretch-wrap machine having a guide ski thereon for guiding the stretch-wrap machine around material in a stationary position which is to be stretch-wrapped.

It is thus an object of this invention to provide a self-guiding stretch-wrap machine which is capable of moving around material to be wrapped so that the stretch-wrap on the motive unit can be released with controlled tension to wrap stationary material loads, with a guide ski for engagement with the stationary material loads. it is a further object to provide an improved contact between the stretch-wrap machine and the stationary material to be wrapped in the form of a guide ski which engages the material to be wrapped and steers the self-guiding stretch-wrap machine in a direction for material wrapping.

It is a further object to provide another guide structure in the form of a guide ski having an auxiliary guide wheel therein for the guidance of a stretch-wrap machine so that the guide ski is able to guide the stretch-wrap unit around irregular material loads while the auxiliary wheel therein is utilized when the load has straight surfaces thereon in the direction of guidance.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figure 1:
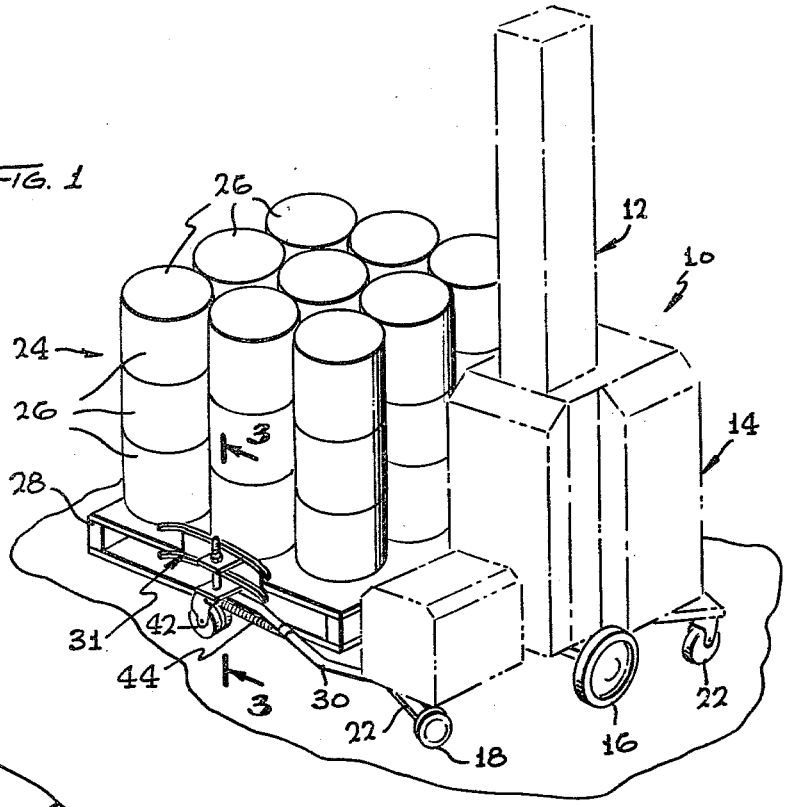
FIG. 1 is a perspective view of a self-guiding stretch-wrap machine having the first preferred embodiment of the guide ski assembly of this invention employed in connection therewith.

Stretch-wrap machine 10 is illustrated in FIG. 1. It comprises stretch-wrap unit 12 mounted on motive unit 14. Motive unit 14 is propelled by wheels 16 and is steered by a pair of steering wheels 18 and 19 which are supported on front steering axle 20. The motive unit may also receive support from one or more casters, one of which is indicated at 22. This structure is described in more detail in Goldstein U.S. Pat. No. 4,095,395, the entire disclosure of which is incorporated herein by this reference.

The material to be wrapped is generally indicated at 24 and comprises a plurality of small drums or other material packages stacked on pallet 28. The stretch-wrap machine 10 is self-guided around the pallet with its packages, while the stretch-wrap units winds the packages with stretch-wrap film to bind the packages into a single material unit.

Figure 2:
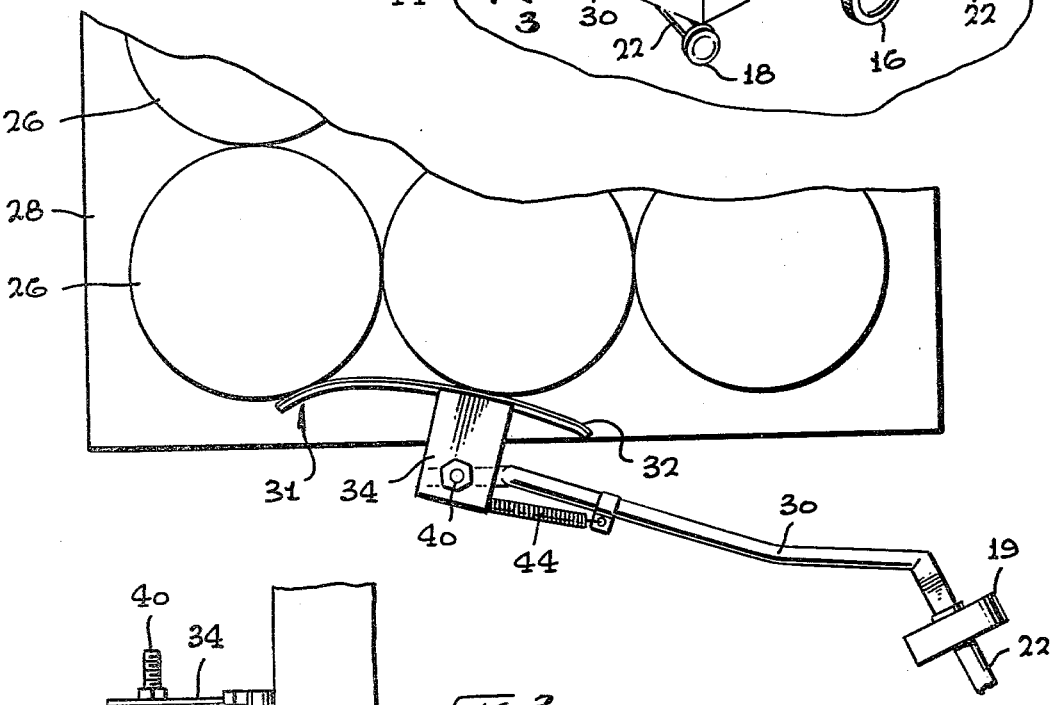
FIG. 2 is an enlarged top plan view of the guide ski assembly of FIG. 1 in association with its related guiding structure and the material load.

Feeler arm 30, see FIGS. 1 and 2, is mounted to guide the motive unit 14. As illustrated in FIG. 2, it is mounted on the inner end of front axle 20 inboard of inner wheel 19. The steering of the motor unit is stressed to turn the motive unit in a tight circle in the clockwise direction, and it is the responsibility of feeler arm 30 to steer the motive unit outward from this tight circle.

Figure 3:
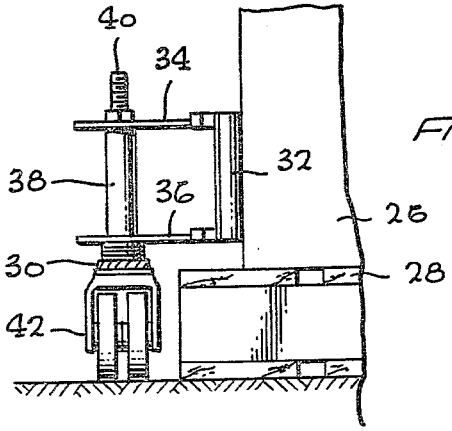
FIG. 3 is an enlarged elevational view taken generally along the line 3—3 of FIG. 1, with parts broken away.

In accordance with this invention, the outer end of feeler arm 30 carries ski assembly 31. The assembly has ski 32 which is mounted on upper and lower brackets 34 and 36 (see FIG. 3). Upper and lower brackets 34 and 36 are separated by spacer tube 38. Pivot pin 40 passes downward through the upper and lower brackets, as well as spacer tube 38, and through an opening in the forward end of feeler arm 30. The lower end of pivot pin 40 carries caster 42. The ski assembly 31 comprising ski 32, upper and lower brackets 34 and 36, as well as spacer tube 38 is freely pivotable on pivot pin 40. Furthermore, feeler arm 30 is freely pivoted on the pivot pin. Thus, each can turn in the required direction, and the caster can perform its own turning, as required.

As previously described, the steering of the motive unit is stressed to turn toward the pallet and its material packages 26. Ski 32 is shaped in such a manner as to prevent it from engaging deeply between the packages 26. For that reason, the radius of curvature of ski 32 is smaller toward its front end and larger toward its rear (to the right in FIG. 2) to permit it to ride over the irregular surfaces of material packages 26. In order to prevent the front end of ski 32 from digging in between the packages, tension spring 44 is engaged between upper bracket 34 and feeler arm 30 in order to resiliently stress the ski assembly in the counter-clockwise direction. This stress prevents the front end of the ski from digging in between the packages, tension spring 44 is engaged between upper bracket 34 and feeler arm 30 in order to resiliently stress the ski assembly in the counter-clockwise direction. This stress prevents the front end of the ski from digging into interstices between material packages. Caster 42 holds the ski above pallet 20 so that the stretch-wrap machine follows the material packages instead of the pallet. Ski 32 is supported far enough away from pivot pin 40 by virtue of its upper and lower brackets 34 and 36 so that caster 42 does not engage on the pallet.

Figure 4:
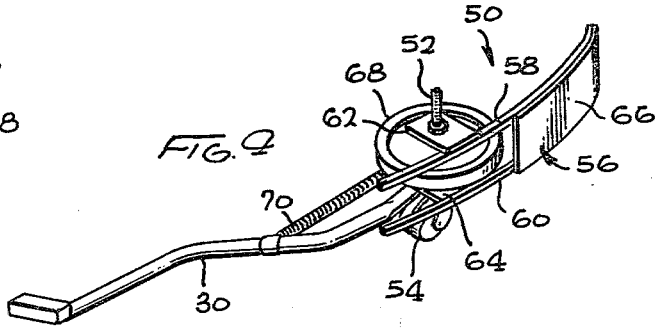
FIG. 4 is a perspective view of the second preferred embodiment of the guide ski assembly of this invention with an auxiliary guide wheel.

FIG. 4 illustrates the second preferred embodiment of the ski assembly, which is indicated at 50 therein. Ski assembly 50 is mounted on feeler arm 30 on pivot pin 52 which has caster 54 at the bottom thereof. Ski 56 is formed of upper and lower ski bars 58 and 60. Upper and lower brackets 62 and 64 are respectively secured to the upper and lower ski bars 58 and 60. The brackets contain pivot openings through which pivot pin 52 engages. Panel 66 is secured to both of the ski bars to provide more engagement area at the front end of ski 56. Wheel 68 is rotatably mounted on pivot pin 52 and extends between ski bars 58 and 60 to extend a short distance therethrough. Wheel 68 is thus active when the surface of the material packages to be wrapped are fairly flat. In this way, the friction of the curved ski is overcome. Tension spring 70 resiliently swings the ski assembly in the counter-clockwise direction as seen in FIG. 4 so that the front end of ski assembly 56 is ineffective when the ski is moving over straight surfaces so that the wheel 68 is effective in such wrapping situations. Thus, either of the skis is able to guide the stretch-wrap machine around material packages which may be irregular or have interstices therebetween.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A guide ski assembly for attachment to the feeler arm of a self-guiding stretch-wrap machine for guiding the stretch-wrap machine around material packages so that stretch-wrap material can be wrapped around the material packages to bind them into a material unit, said guide ski assembly comprising:

a curved guide ski for contact with material packages, said guide ski having a front end and being curved to simultaneously engage a plurality of said packages to avoid engagement of said front end of said guide ski in spaces between material packages to be wrapped;

means for pivotably mounted said guide ski on the feeler arm so that the guide ski can continuously pivot on the feeler arm in accordance with the shape of said guide ski and the shape of the material packages; and a spring attached between said guide ski assembly and the feeler arm to resiliently urge rotation of said guide ski assembly on the feeler arm on its pivot in a direction to move said front end of said guide ski away from the material packages to be wrapped.

2. The guide ski assembly of claim 1 wherein said mounting means comprises at least one bracket on said guide ski and a pivot pin extending through said guide ski bracket and through the feeler arm.

3. The guide ski assembly of claim 1 wherein said mounting means comprises upper and lower spaced brackets secured to said ski and a spacer between said upper and lower brackets, said mounting means also comprising a pivot pin extending through said upper and lower brackets and through the feeler arm for pivotably mounting said ski on the feeler arm.

4. The guide ski assembly of claim 3 wherein a caster wheel is mounted below said lower bracket as part of said guide ski assembly and said upper and lower brackets are sufficiently long to position said guide ski laterally from said caster wheel.

5. The guide ski assembly of claim 4 wherein said caster wheel is mounted on said pivot pin.

6. The guide ski assembly of claim 5 further including a guide wheel forming part of said guide ski assembly and positioned to guide said assembly.

7. The guide ski assembly of claim 6 wherein said guide wheel is rotatably mounted on said pivot pin and extends laterally beyond at least a portion of said ski so that it can contact material packages for control of the feeler arm.

8. The guide ski assembly of claim 2 wherein an auxiliary guide wheel is rotatably mounted as part of said guide ski assembly, said guide wheel extending laterally beyond at least a portion of said guide ski so that the guide wheel can contact material packages for control of the feeler arm.

9. The guide ski assembly of claim 8 wherein said guide ski comprises upper and lower ski bars and a ski panel attached thereto adjacent the front end thereof and said guide wheel extends between said ski bars, upper and lower brackets respectively secured to said upper and lower ski bars and a pivot pin through said upper and lower brackets, said guide wheel and the feeler arm to pivotably mount said guide ski assembly on the feeler arm.

10. The guide ski assembly of claim 9 wherein a spring is attached between said guide ski assembly and the feeler arm to resiliently urge rotation of said guide ski assembly on the feeler arm.

11. The guide ski assembly of claim 10 further including in combination a steerable motive unit having a feeler arm thereon, said guide ski assembly being pivotably attached to said feeler arm for steering guidance of said motive unit, and further in combination a stretch-wrap unit on said motive unit for wrapping stretch-wrap film around material packages to bind them into a unit of material packages.

12. A guide assembly comprising:

a feeler arm for attachment to a self-guiding stretch-wrap machine for guiding the stretch-wrap machine around material packages so that the stretch-wrap material can be wrapped around the material packages to bind them into a material unit;

a guide ski assembly attached to said feeler arm, said guide ski assembly comprising a curved guide ski to simultaneously engage a plurality of said packages, said guide ski having a front end which is curved to avoid engagement of said front end of said guide ski in spaces between material packages to be wrapped;

means for pivotably mounting said guide ski on said feeler arm so that said guide ski can pivot on the feeler arm while guided by the material packages in accordance with the shape of said guide ski and the shape of the material packages; and a spring interengaged between said feeler arm and said guide ski to resiliently urge the front end of said guide ski in a direction away from the material packages so that said front end of said guide ski is inhibited from digging in between material packages and said guide ski is guided by the material packages.

13. The guide ski assembly of claim 12 wherein said mounting means comprises upper and lower spaced brackets secured to said ski and a spacer between said upper and lower brackets, said mounting means also comprising a pivot pin extending through said upper and lower brackets and through the feeler arm for pivotably mounting said ski on the feeler arm.

14. The guide ski assembly of claim 13 wherein a caster wheel is mounted below said lower bracket as part of said guide ski assembly and said upper and lower brackets are sufficiently long to position said guide ski laterally from said caster wheel.

15. A stretch-wrap machine comprising:

a self-propelled motive unit having a stretch-wrap unit thereon and having a wheel thereunder so that the motive unit can propel and guide the stretch-wrap unit around material packages so that stretch-wrap material can be wrapped around the material packages to bind them into a material unit;

guide means for guiding said motive unit around the material packages, said guide means comprising a feeler arm connected to said wheel to steer said motive unit, a guide ski assembly attached to the feeler arm, said guide ski assembly comprising:

a curved guide ski to simultaneously engage a plurality of said packages, said guide ski having a front end and being curved to avoid engagement of said front end of said guide ski in spaces between the material packages to be wrapped;

means for pivotably mounting said guide ski on the feeler arm so that the guide ski can pivot on the feeler arm while guided by the material packages in accordance with the shape of said guide ski and the shape of the material package; and a spring interconnected between said guide ski and said feeler arm to resiliently urge rotation of said guide ski on said feeler arm in a direction to move the front end of said guide ski in a direction away from the material packages.

16. The strech-wrap machine of claim 15 wherein said mounting means comprises upper and lower spaced brackets secured to said ski and a spacer between said upper and lower brackets, said mounting means also comprising a pivot pin extending through said upper and lower brackets and through the feeler arm for pivotably mounting said ski on the feeler arm.

17. The stretch-wrap machine of claim 16 wherein a caster wheel is mounted below said lower bracket as part of said guide ski assembly and said upper and lower brackets are sufficiently long to position said guide ski laterally from said caster wheel.

18. The stretch-wrap machine of claim 15 wherein said curved guide ski has a smaller radius of curvature toward its front end and a larger radius of curvature away from its front end.

* * * * *